US007690701B2

(12) United States Patent
Van Ravenhorst

(10) Patent No.: US 7,690,701 B2
(45) Date of Patent: Apr. 6, 2010

(54) WALK-IN BATHTUB ADJUSTABLE DOOR LATCH ASSEMBLY

(75) Inventor: Peter Van Ravenhorst, Boise, ID (US)

(73) Assignee: Best Bath Systems, Inc., Bosie, ID (US)

( * ) Notice: Subject to any disclaimer, the term of this patent is extended or adjusted under 35 U.S.C. 154(b) by 437 days.

(21) Appl. No.: 11/590,486

(22) Filed: Oct. 30, 2006

(65) Prior Publication Data

US 2008/0111383 A1 May 15, 2008

(51) Int. Cl.
*E05C 3/02* (2006.01)

(52) U.S. Cl. ..... 292/194; 292/336.3

(58) Field of Classification Search ..... 292/194, 292/336.3, 57, 66, DIG. 7, 350, 354, 356–357; 4/555–557; 16/110.1; 70/78, 91, 101, 207, 70/209

See application file for complete search history.

(56) References Cited

U.S. PATENT DOCUMENTS 3,719,960 A * 3/1973 Russell ..... 4/556
3,746,382 A * 7/1973 Hancock ..... 292/241
4,155,579 A * 5/1979 Sanok, Jr. ..... 292/336.3
4,306,432 A * 12/1981 Ravid ..... 70/120
7,100,951 B2 * 9/2006 Jien ..... 292/207
7,117,712 B1 * 10/2006 Palzkill ..... 72/453.15

* cited by examiner

*Primary Examiner*—Carlos Lugo
*Assistant Examiner*—Kristina R Fulton
(74) *Attorney, Agent, or Firm*—Charles R. Clark

(57) ABSTRACT

A walk-in bathtub adjustable door latch assembly incorporates an adjustably positionable closing lever to secure and to adjustably move and adjustably pressure a hinged door of a walk-in bathtub into a close sealing position in a bather entryway to guard against water leakage through the bather entryway.

16 Claims, 5 Drawing Sheets

WALK-IN BATHTUB ADJUSTABLE DOOR LATCH ASSEMBLY

CROSS-REFERENCE TO RELATED APPLICATIONS

Not applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

In modern society, a bathtub is becoming more frequently a walk-in bathtub having a hinged door and having a compressible door seal closing and sealing the door in a bather entryway through a side tub wall. The bather entryway is used by a bather to enter and exit the bathtub.

The present invention a walk-in bathtub adjustable door latch assembly employs a novel adjustably positionable closing lever to secure and to adjustably move and adjustably pressure a hinged door into a close sealing position in a bather entryway to guard against water leakage through the bather entryway.

BRIEF SUMMARY OF THE INVENTION

An object of the present invention is to provide a walk-in bathtub adjustable door latch assembly incorporating a novel adjustably positionable closing lever to secure and to adjustably move and adjustably pressure a door into a close sealing watertight position in a bather entryway that passes through a side tub wall.

Another object is to provide a latch assembly having a closing lever that engages the edge of the hinged door before the door seal begins to compress and thus makes the door easier to close and secure by a bather limited to using one hand either by choice or disability.

A further object is to provide easy and simple adjustment of the closing lever that is integral with the structure that incorporates the lever into the door latch assembly.

A further object is to provide a rugged and durable latch assembly that is aesthetically pleasing to a bather.

The present invention incorporates a secure, uncomplicated relatively unbreakable and inexpensively produced closing lever and thereby provides an improved door latch assembly.

Additional and various other objects and advantages attained by the invention will become more apparent as the specification is read and the accompanying figures are reviewed.

DETAILED DESCRIPTION OF THE INVENTION

Referring to FIGS. 1 through 15, the present invention is a novel walk-in bathtub adjustable door latch assembly 20.

Figure 1:
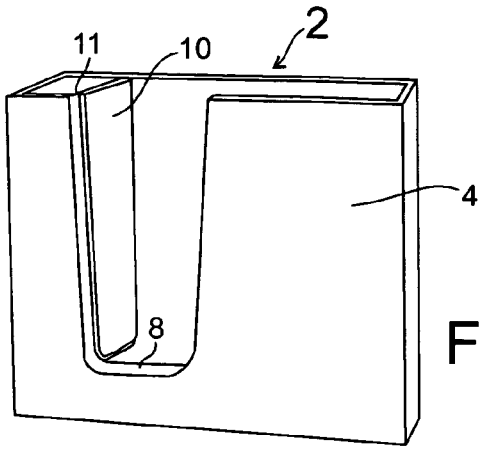
FIG. 1 is a perspective view of a walk-in bathtub having a hinged door.

FIG. 1 shows a walk-in bathtub 2 preferably made of molded fiberglass reinforced plastic having a bathtub side wall 4. The side wall 4 has a bather entryway 8 that allows a bather to enter and exit the bathtub 2. An inwardly swinging entryway hinged door 10 has a hinge 11 that mounts the door in the bather entryway 8. An entryway door seal 12 is attached along portions of the door 10 that are interstitially positioned and compressed between the door and the edges of the bather entryway 8 during closing and sealing of the door in the entryway.

Figure 2:
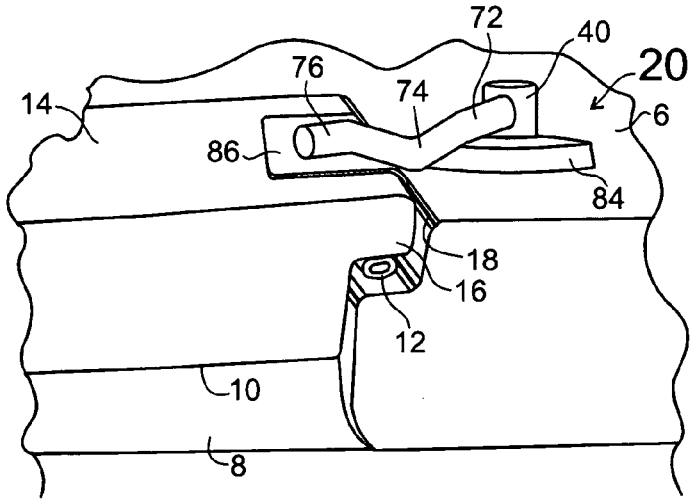
FIG. 2 is a perspective partial view from above of the preferred embodiment of a walk-in bathtub adjustable door latch assembly in an intermediate position during closing and securing of a hinged door and showing an uncompressed door seal.

FIG. 2 shows an inward facing door surface 14 of the hinged door 10 that faces towards the interior of the bathtub and shows a portion of the uncompressed door seal 12 interstitially between a swinging end 16 of the door (away from the hinge) and a portion of the entryway 8. FIG. 2, further shows the door latch assembly 20 attached to an inward facing surface 6 of a bathtub sidewall near an inner opening side edge 18 of the entryway 8, shows the latch assembly in an intermediate position during closing and securing of the door 10, and shows a middle portion 74 of the latch assembly in contact with a lever contact strike plate 86. Preferably, the strike plate 86 is made of high density polyethylene plastic and is attached to the inward facing door surface 14 and along the edge of the door nearest the latch assembly to cooperate with the middle bowed portion 74.

Figure 3:
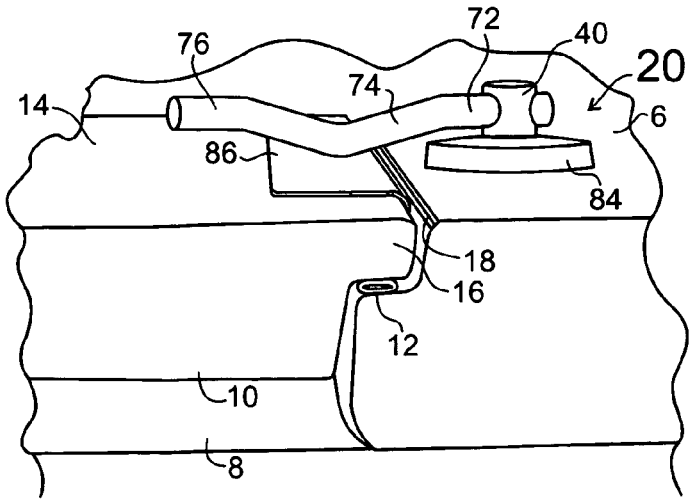
FIG. 3 is a perspective partial view from above of the preferred embodiment of a walk-in bathtub adjustable door latch assembly showing the hinged door and the latch assembly in a closed condition and showing a compressed door seal.

FIG. 3 shows the door 10 in a closed position with the latch assembly 20 pressuring and securing the door in the closed position and compressing the door seal 12. Preferably, the door seal 12 is a silicone bulb seal.

Figure 4:
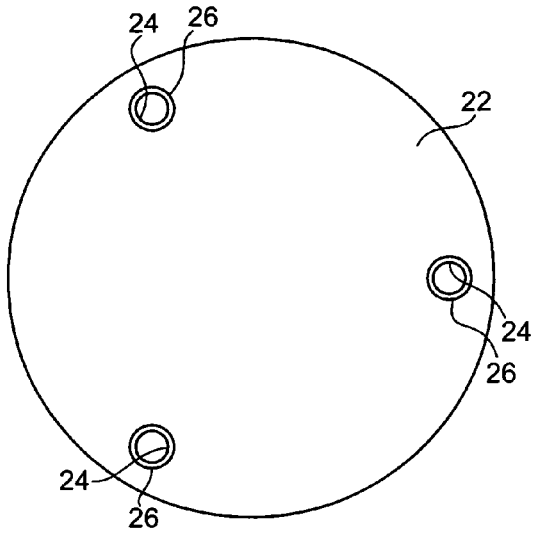
FIG. 4 is a top plan view of a base friction disc.

FIG. 4 shows a base friction disc 22 preferably made of 360 brass alloy and having three angularly and radially spaced transverse base friction disc mounting bores 24. Each base friction disc mounting bore 24 may have a base friction disc counterbore 26.

Figure 5:
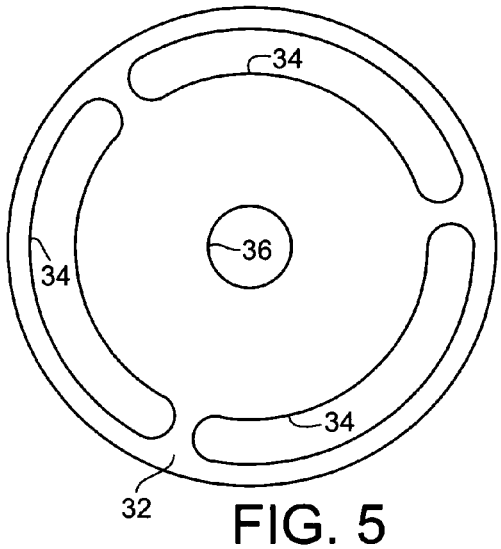
FIG. 5 is a top plan view of a slotted rotating disc.

FIG. 5 shows a slotted rotating disc 32 that in the latch assembly 20 is rotatably centered on the base friction disc 22 (see FIG. 11), the slotted rotating disc preferably is made of stainless steel, is sized to overlay the base friction disc, and has three angularly and radially spaced equal radius slots 34 sized and located to cooperate with the base friction disc mounting bores 24 and sized to receive and slidingly retain three spacer bushings 54 respectively with one bushing within each slot. Preferably, a center post mounting bore 36 is transverse through the slotted rotating disc 32 at its center.

Figure 6:
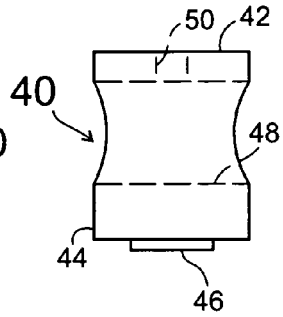
FIG. 6 is a side view of a center post.

FIG. 6 shows a center post 40 preferably made of stainless steel having a free end 42 and a mounting end 44 with the mounting end preferably having a mounting nub 46. The center post 40 has a transverse lever bore 48 near its free end 42, and a set screw receiving bore 50 intersecting said lever bore 48 near its midlength.

Figure 7:
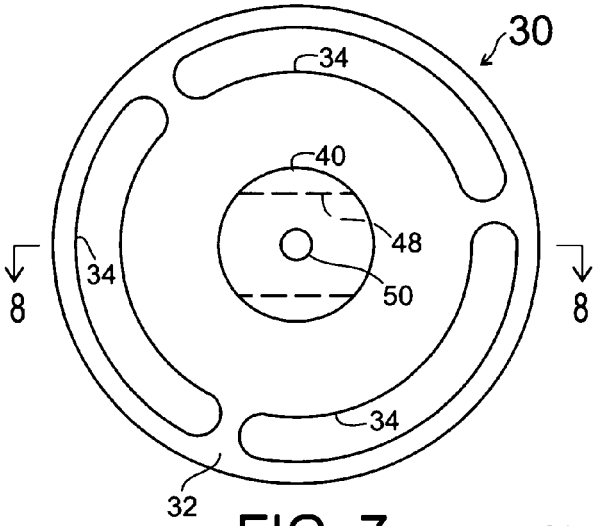
FIG. 7 is a top view of a slotted rotating disc assembly.

FIG. 7 shows a top view of a slotted rotating disc assembly 30 comprising the slotted rotating disc 32 and the center post 40.

Figure 8:
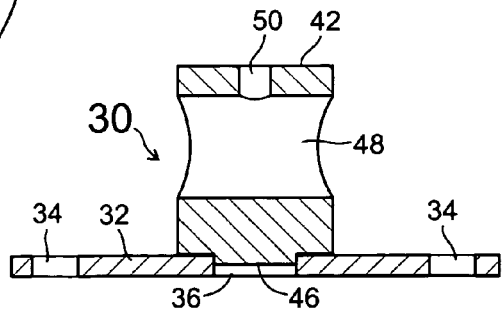
FIG. 8 is a cross-sectional view of the slotted rotating disc assembly as viewed in direction 8-8 in FIG. 7.

As best seen in FIG. 8, the center post 40 at its mounting end 44 is fixed perpendicularly to the center of the slotted rotating disc 32 preferably by welding. In the disc assembly 30, the center post 40 has a transverse lever bore 48 spaced from and parallel to the slotted rotating disc 32. Preferably, the mounting nub 46 is sized to fit within the center post mounting bore 36 of the slotted rotating disc 32 to facilitate the fixing of the center post 40 to the slotted rotating disc. In the assembled latch assembly 20, a set screw 52 is removably fixed in the set screw receiving bore 50.

Figure 11:
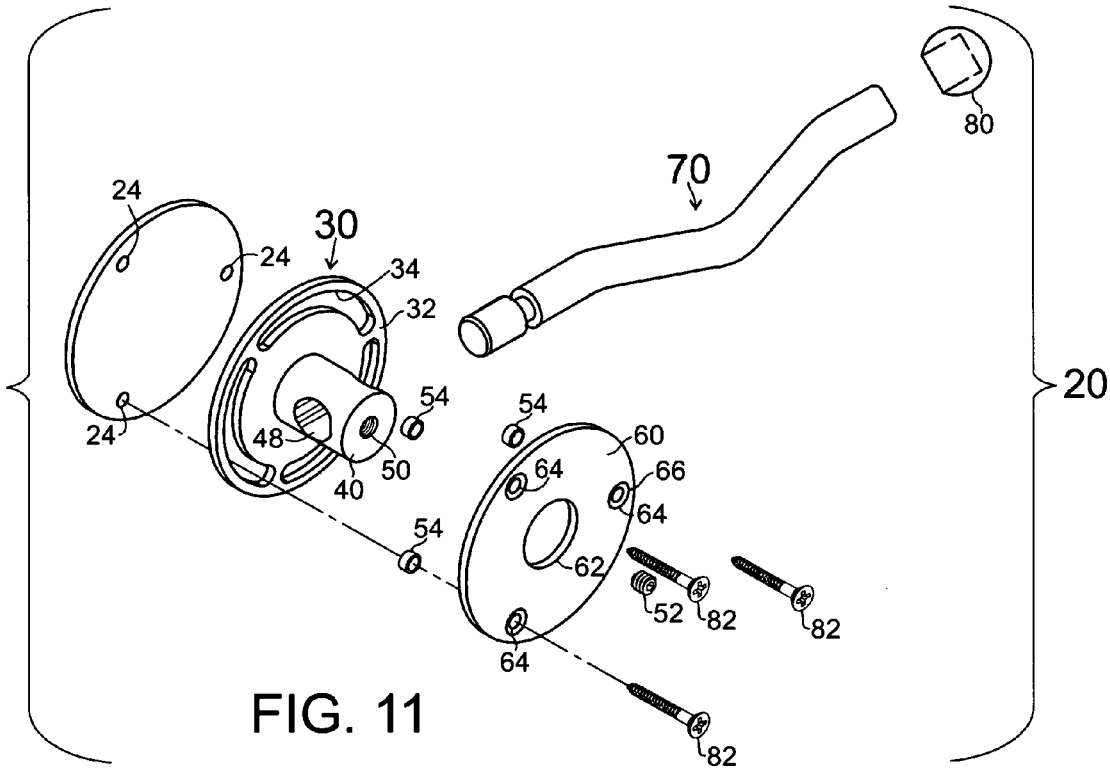
FIG. 11 is an exploded perspective view of the door latch assembly of the preferred embodiment (escutcheon not shown)

As best seen in FIG. 11, three spacer bushings 54 are sized to slidingly fit and be retained respectively with one said bushing within each slot 34.

Figure 9:
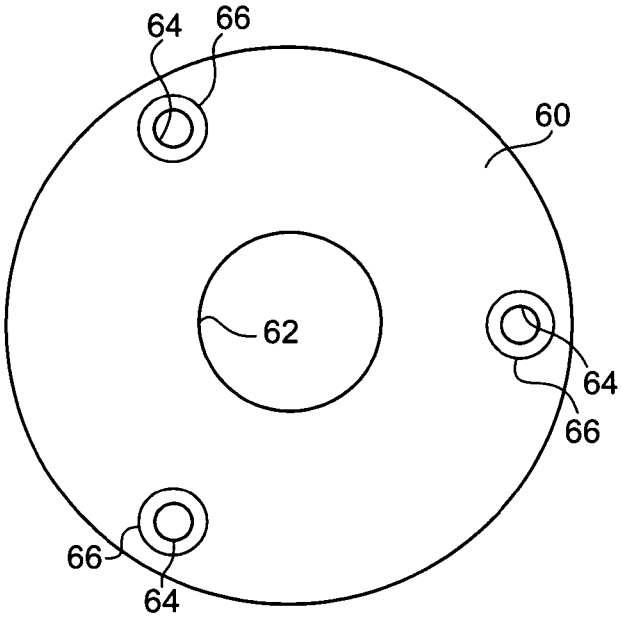
FIG. 9 is a top plan view of a top friction disc.

FIG. 9 shows a top friction disc 60 preferably made of 360 brass alloy having a center post receiving bore 62 at its center sized to closely and rotatably receive the center post 40 during assembly of the latch assembly 20. The top friction disc 60 has three angularly and radially spaced transverse top friction disc mounting bores 64, said top friction disc is sized to overlay the slotted rotating disc 32, and the top friction disc mounting bores in the assembled latch assembly 20 are coaxial respectively to the base friction disc mounting bores 24. Each top friction disc mounting bore 64 may have a top friction disc upper counterbore 66.

Figure 10:
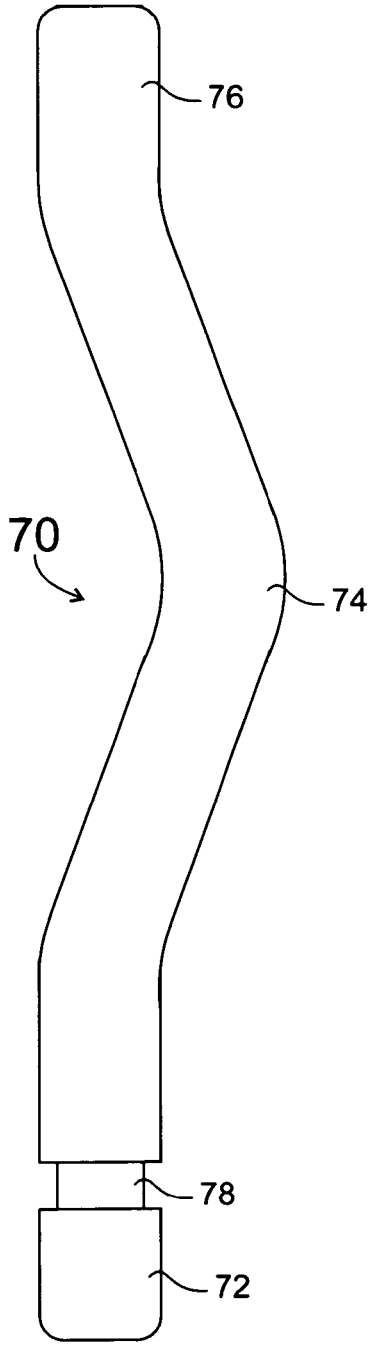
FIG. 10 is a side view of a closing lever (ball end not shown)

FIG. 10 shows a closing lever 70. Preferably, the closing lever 70 has a first straight portion 72 transitioning into a middle bowed portion 74 and the middle bowed portion transitioning into a free straight portion 76 and preferably the first straight portion has an annular set screw receiving groove 78 located near the midlength of the first portion. During assembly of the latch assembly 20, the lever 70 is rotatably and adjustably mounted in the lever bore 48 (see FIGS. 2, 3, and 11 to 15).

FIG. 11 is an exploded view of the components of the latch assembly 20 of the preferred embodiment. During assembly of the latch assembly 20, three mounting screws 82 are inserted and retained respectively with one said screw through each top friction disc mounting bore 64, each spacer bushing 54, each slot 34, and each base friction disc mounting bore 24.

Figure 12:
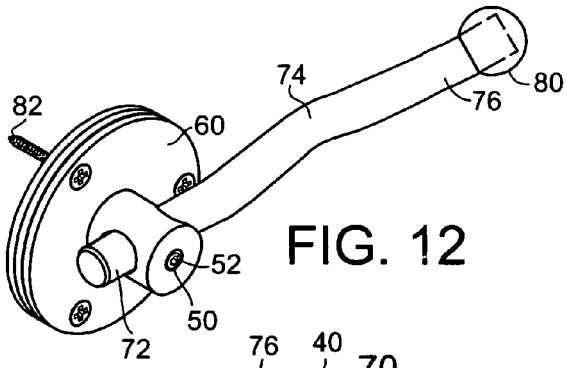
FIG. 12 is a perspective view of the door latch assembly of the preferred embodiment (escutcheon not shown)

FIG. 12 shows an assembled latch assembly 20, shows the center post 40 received in said center post receiving bore 62, and shows a ball end 80 attached to the free straight portion 76 at its free end.

Figure 13:
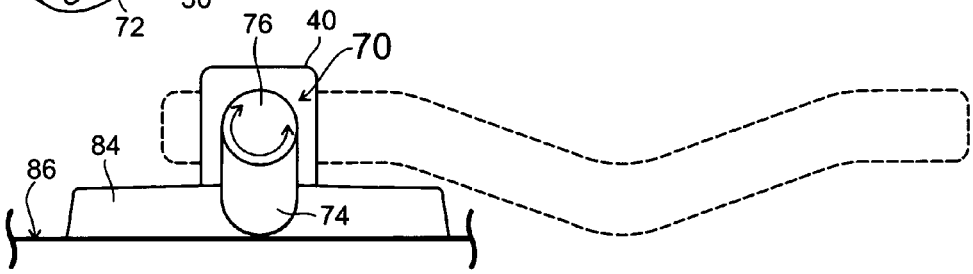
FIG. 13 is a side view of the door latch assembly showing the closing lever in a closed position showing a maximum closure position of a bowed portion of the closing lever and showing the closing lever in an alternative open position (ball end not shown)

In the preferred embodiment of the latch assembly 20, the longitudinal axis of the first straight portion 72 and the longitudinal axis of the free straight portion 76 are coaxial. FIG. 13 shows with an double ended arrow marked on the end of the free straight portion 76 how the closing lever 70 can be rotated around the longitudinal axis of the first straight portion 74 to vary the lateral distance of the contact point of the middle bowed portion 74 relative to the lever contact strike plate 86, shows a position of maximum displacement of the lever contact strike plate, and shows an alternative position of the closing lever.

Figure 14:
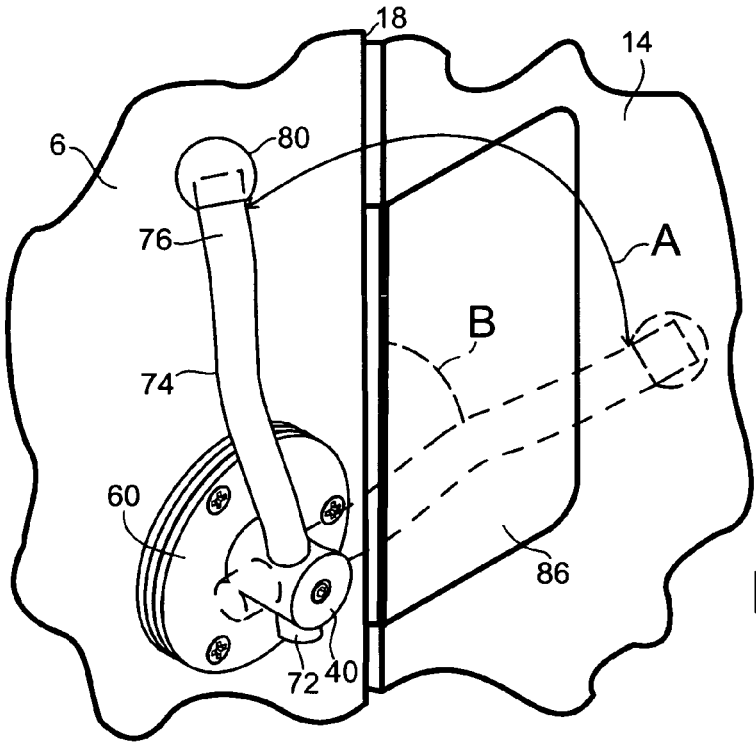
FIG. 14 is a perspective partial view from above and inside the bathtub of the preferred embodiment of a walk-in bathtub adjustable door latch assembly in an open position, showing an alternative closed position (escutcheon not shown), showing an arrow A that indicates a movement arc of the closing lever, showing a dashed line B that indicates an arc of path of contact point of a middle bowed portion of the closing lever on a lever contact strike plate, and showing the hinged door ajar.
Figure 15:
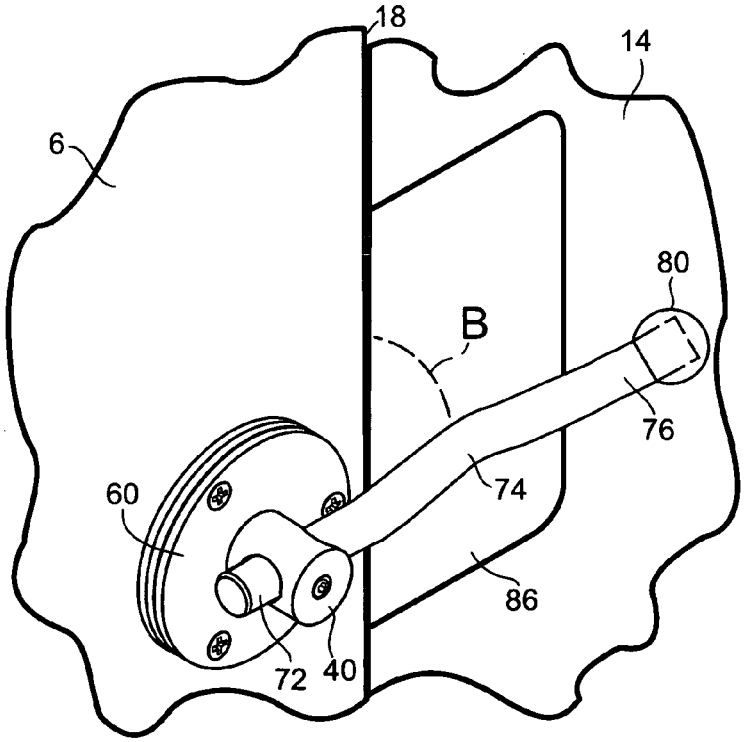
FIG. 15 is a perspective partial view from above and inside the bathtub of the preferred embodiment of a walk-in bathtub adjustable door latch assembly in a closed condition (escutcheon not shown) and showing the hinged door in a closed position.

The mounting screws 82 are used to attach the latch assembly 20 to the inward facing surface 6 of a bathtub side wall (as best seen in FIGS. 14 and 15) adjacent to the bather entryway 8 and the latch assembly positioned to cooperatively interact with a swinging end 16 of an inwardly swinging entryway hinged door 10.

Preferably, in the assembled latch assembly 20, the spacer bushings 54 are retained within the slots 34 of the slotted rotating disc 32 and sized to space the base friction disc 22 from the top friction disc 60 and thereby limit the amount of tension that can be applied to the slotted rotating disc by the mounting screws 82 and thereby allowing the slotted disc assembly 30 to rotate between the friction discs 22 and 60.

FIGS. 2, 3, and 13 show an escutcheon 84 having an escutcheon center bore mounted over and concealing the base friction disc 22, the slotted disc assembly 30, the spacer bushings 54, and the mounting screws 82.

Preferably the spacer bushings 54 are made from stainless steel tubing. Preferably, the slotted rotating disc 32, the center post 40, the closing lever 70, the set screw 52, the mounting screws 82, and the escutcheon 84 are made from stainless steel.

Alternatively, the middle bowed portion can comprise a descending segment having a longitudinal axis angling obliquely away from the longitudinal axis of said first straight portion, said descending segment transitioning into a zone of maximum lateral displacement away from the longitudinal axis of said first straight portion, and said zone transitioning into an ascending segment having a longitudinal axis angling obliquely back towards the longitudinal axis of said first straight portion.

Alternatively, the middle bowed portion can comprise a curved portion that first curves away from the longitudinal axis of said first straight portion and then curves back towards the longitudinal axis of said first straight portion.

Alternatively, the first straight portion may have an annular set screw receiving groove located near the free end of the first straight portion.

The preceding description and exposition of the invention is presented for purposes of illustration and enabling disclosure. It is neither intended to be exhaustive nor to limit the invention to the precise forms disclosed. Modifications or variations in the invention in light of the above teachings that are obvious to one of ordinary skill in the art are considered within the scope of the invention as determined by the appended claims when interpreted to the breath to which they fairly, legitimately and equitably are entitled.

I claim:

1. A walk-in bathtub adjustable door latch assembly to secure and to adjustably position an inwardly swinging entryway hinged door in a bather entryway of a walk-in bathtub comprising:

a base friction disc, said base friction disc having three angularly and radially spaced transverse base friction disc mounting bores;

a slotted rotating disc rotatably centered on said base friction disc, said slotted rotating disc sized to overlay said base friction disc, said slotted rotating disc having three angularly and radially spaced equal radius slots sized and located to cooperate with said base friction disc mounting bores;

a center post fixed perpendicularly to the center of said slotted rotating disc, said center post having a transverse lever bore spaced from and parallel to said slotted rotating disc, said center post having a set screw receiving bore intersecting said lever bore near said lever bore's midlength;

three spacer bushings sized to slidingly fit and be retained respectively with one said bushing within each said slot;

a top friction disc having a center post receiving bore at its center sized to closely and rotatably receive said center post, said center post received in said center post receiving bore, said top friction disc having three angularly and radially spaced transverse top friction disc mounting bores, said top friction disc sized to overlay said slotted rotating disc, said top friction disc mounting bores coaxial respectively to said base friction disc mounting bores;

three mounting screws inserted and retained respectively with one said screw through each said top friction disc mounting bore, each said spacer bushing, each said slot, and each said base friction disc mounting bore;

a closing lever rotatably and adjustably mounted in said lever bore, said closing lever having a first straight portion transitioning into a middle bowed portion, and said middle bowed portion transitioning into a free straight portion, and said closing lever adjustably rotatable about said first straight portion's longitudinal axis; and a set screw removably fixed in said set screw receiving bore.

2. A walk-in bathtub adjustable door latch assembly according to claim 1 attached to an inward facing surface of a bathtub side wall adjacent said bather entryway and said latch assembly positioned to cooperatively interact with a swinging end of said inwardly swinging entryway hinged door.

3. A walk-in bathtub adjustable door latch assembly according to claim 2 wherein said middle bowed portion comprising a descending segment having a longitudinal axis angling obliquely away from the longitudinal axis of said first straight portion, said descending segment transitioning into a zone of maximum lateral displacement away from the longitudinal axis of said first straight portion, and said zone transitioning into an ascending segment having a longitudinal axis angling obliquely back towards the longitudinal axis of said first straight portion.

4. A walk-in bathtub adjustable door latch assembly according to claim 2 wherein said middle bowed portion comprising a curved portion that first curves away from the longitudinal axis of said first straight portion and then curves back towards the longitudinal axis of said first straight portion.

5. A walk-in bathtub adjustable door latch assembly according to claim 2 further comprising a ball end attached to said free straight portion at said free straight portion's free end.

6. A walk-in bathtub adjustable door latch assembly according to claim 3 further comprising a ball end attached to said free straight portion at said free straight portion's free end.

7. A walk-in bathtub adjustable door latch assembly according to claim 4 further comprising a ball end attached to said free straight portion at said free straight portion's free end.

8. A walk-in bathtub adjustable door latch assembly according to claim 1 wherein said first straight portion having an annular set screw receiving groove located near said first straight portion's free end.

9. A walk-in bathtub adjustable door latch assembly according to claim 3 wherein said first straight portion having an annular set screw receiving groove located near said first straight portion's free end.

10. A walk-in bathtub adjustable door latch assembly according to claim 4 wherein said first straight portion having an annular set screw receiving groove located near the free end of said first straight portion's free end.

11. A walk-in bathtub adjustable door latch assembly according to claim 1 wherein said first straight portion having an annular set screw receiving groove located near said first straight portion's midlength.

12. A walk-in bathtub adjustable door latch assembly according to claim 3 wherein said first straight portion having an annular set screw receiving groove located near said first straight portion's midlength.

13. A walk-in bathtub adjustable door latch assembly according to claim 4 wherein said first straight portion having an annular set screw receiving groove located near said first straight portion's midlength.

14. A walk-in bathtub adjustable door latch assembly to secure and to adjustably position an inwardly swinging entryway hinged door in a bather entryway of a walk-in bathtub with said door having an entryway door seal and an inward facing door surface comprising:

a base friction disc, said base friction disc having three angularly and radially spaced transverse base friction disc mounting bores;

a slotted rotating disc rotatably centered on said base friction disc, said slotted rotating disc sized to overlay said base friction disc, said slotted rotating disc having three angularly and radially spaced equal radius slots sized and located to cooperate with said base friction disc mounting bores;

a center post fixed perpendicularly to the center of said slotted rotating disc, said center post having a transverse lever bore spaced from and parallel to said slotted rotating disc, said center post having a set screw receiving bore intersecting said lever bore near said lever bore's midlength;

three spacer bushings sized to slidingly fit and be retained respectively with one said bushing within each said slot;

a top friction disc having a center post receiving bore at its center sized to closely and rotatably receive said center post, said center post received in said center post receiving bore, said top friction disc having three angularly and radially spaced transverse top friction disc mounting bores, said top friction disc sized to overlay said slotted rotating disc, said top friction disc mounting bores coaxial respectively to said base friction disc mounting bores;

three mounting screws inserted and retained respectively with one said screw through each said top friction disc mounting bore, each said spacer bushing, each said slot, and each said base friction disc mounting bore;

a closing lever, said closing lever having a first straight portion transitioning into a middle bowed portion transitioning into a free straight portion; said first straight portion having an annular set screw receiving groove located near said first straight portion's midlenath, said closing lever rotatably and adjustably mounted in said lever bore and said closing lever adiustably rotatable about said first straight portion's longitudinal axis; and a set screw removably fixed in said set screw receiving bore.

15. A walk-in bathtub adjustable door latch assembly according to claim 14 further comprising a substantially flat lever contact striker plate attached to said inward facing door surface to cooperate with said middle bowed portion.

16. A walk-in bathtub adjustable door latch assembly according to claim 2 further comprising a substantially flat lever contact striker plate attached to an inward facing door surface of said door to cooperate with said middle bowed portion.

* * * * *